US009381761B2

(12) United States Patent
Takata

(10) Patent No.: US 9,381,761 B2
(45) Date of Patent: Jul. 5, 2016

(54) INKJET PRINTER

(71) Applicant: RISO KAGAKU CORPORATION, Tokyo (JP)

(72) Inventor: Atsushi Takata, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/925,066

(22) Filed: Oct. 28, 2015

(65) Prior Publication Data

US 2016/0121635 A1 May 5, 2016

(30) Foreign Application Priority Data

Oct. 29, 2014 (JP) ..... 2014-220123

(51) Int. Cl.

| | |
|---|---|
| ***B41J 2/165*** | (2006.01) |
| ***B41J 2/175*** | (2006.01) |
| ***B41J 29/17*** | (2006.01) |
| ***B41J 2/01*** | (2006.01) |

(52) U.S. Cl.

CPC .. *B41J 29/17* (2013.01); *B41J 2/01* (2013.01); *B41J 2/16517* (2013.01); *B41J 2/175* (2013.01); *B41J 2002/16573* (2013.01)

(58) Field of Classification Search

CPC ..... B41J 2/16517; B41J 2002/16573

See application file for complete search history.

(56) References Cited

U.S. PATENT DOCUMENTS 6,299,277 B1 * 10/2001 Fujii ..... B41J 2/1652 347/23
6,497,469 B1 * 12/2002 Shinada ..... B41J 2/17503 347/7
2014/0049581 A1 * 2/2014 Tanaka ..... B41J 2/16517 347/31

FOREIGN PATENT DOCUMENTS

JP 2006-212868 8/2006

* cited by examiner

*Primary Examiner* — Shelby Fidler
(74) *Attorney, Agent, or Firm* — Hamre, Schumann, Mueller & Larson, P.C.

(57) ABSTRACT

An inkjet printer includes a determination unit, a maintenance setting value decision unit, and a controller. The determination unit determines whether or not an ink cartridge has passed the recommended time limit, based on the manufacturing date or the start-of-use date, the normal consumption period of the ink cartridge, and the elapsed period from the manufacturing date or the start-of-use date of the ink cartridge. The maintenance setting value decision unit reads the cycle and the strength of a maintenance operation for each type of ink from the memory, in a case where the determination unit determines that the recommended time limit has passed, and selects and decides the shortest cycle and the strongest strength, as maintenance setting values. The controller causes a pressure regulator and a pressure regulating drive unit to execute a purge operation, based on the determined maintenance setting values.

3 Claims, 7 Drawing Sheets

11

| | | 11a NAME | 11b SETTING RANGE (MONTH) | 11c SETTING UNIT (MONTH) | 11d DEFAULT (MONTH) |
|---|---|---|---|---|---|
| 111 | NORMAL CONSUMPTION PERIOD | K INK | 1~60 | 1 | 2 |
| | | C INK | 1~60 | 1 | 2 |
| 112 | | ... | | | |
| | RECOMMENDED TERMINATION PERIOD | K INK | 0~20 | 1 | 3 |
| | | C INK | 0~20 | 1 | 3 |
| | | ... | | | |

FIG. 6

| TYPE OF SHEET | CYCLE CORRECTION COEFFICIENT | STRENGTH CORRECTION COEFFICIENT |
|---|---|---|
| MAT PAPER | 0.8 | 1.1 |
| ORDINARY PAPER | 1.0 | 1.0 |
| RECYCLED PAPER | 0.8 | 1.1 |

FIG. 7

| ELAPSED TIME / TEMPERATURE | $0<Y<1$ | $1\leq Y<5$ | $5\leq Y$ |
|---|---|---|---|
| $T<0$ | 1.2 | 1.3 | 1.5 |
| $0<T<10$ | 1.1 | 1.2 | 1.3 |
| $10<T<20$ | 1.0 | 1.0 | 1.0 |
| $20<T<30$ | 0.9 | 0.8 | 0.7 |
| $30<T<40$ | 0.8 | 0.6 | 0.5 |
| $40<T$ | 0.7 | 0.5 | 0.3 |

INKJET PRINTER

CROSS REFERENCE TO RELATED APPLICATION

This application claims benefit of priority under 35 U.S.C. §119 to Japanese Patent Application No. 2014-220123, filed on Oct. 29, 2014, the entire contents of which are incorporated by reference herein.

BACKGROUND OF THE INVENTION

1. Field of the Invention

The present invention relates to an inkjet printer configured to perform maintenance appropriately on all of a plurality of inkjet heads, when performing the maintenance operation by using a maintenance unit common to the plurality of inkjet heads.

2. Description of the Related Art

An inkjet printer is detachably provided with ink cartridges storing respective colors of ink. The inkjet printer prints an image or character on a sheet by supplying ink to an inkjet head from the ink cartridges and discharging the ink on the sheet from nozzles of the inkjet head.

With respect to an ink cartridge, there are many cases where a use period is set as a time period during which the quality of ink is assured. Therefore, a general inkjet printer calculates an expiration date, based on the manufacturing date and the use period stored in the ink cartridge, and when the expiration date of the ink cartridge being used has passed, displays a warning of the fact.

In addition, when an ink cartridge is within a predetermined period (near life) before the expiration date, it is preferable to perform printing by increase in frequency and strength of maintenance such as purging of the inkjet head, although it is possible to continue printing without immediately changing the ink cartridge.

Patent Literature 1 (Japanese Patent Application Laid-Open Publication No. 2006-212868) discloses a technique relating to an inkjet registering apparatus including a recovery unit configured to perform maintenance of a head, a storage unit configured to store information of ink, and a determination unit configured to determine ink deterioration by using the storage unit, wherein the determination unit changes the content of processing by the recovery unit as the ink deteriorates.

The inkjet registering apparatus according to Patent Literature 1 determines ink deterioration for each type of ink based on the ink information and changes the content of processing by the recovery unit (maintenance unit) as the ink deteriorates, and thus the apparatus is assumed to have a recovery unit for each type of ink.

However, the provision of a recovery unit for each type of ink makes the configuration of the apparatus complicated, which results in the increase in production cost. Therefore, an apparatus that is provided with a recovery unit common to a plurality of types of ink and that simultaneously performs maintenance of a plurality of inkjet heads has become the mainstream.

For example, there exists an inkjet printer configured to simultaneously perform a purge operation on a plurality of inkjet heads by providing an air chamber common to a plurality of types of ink and controlling the internal pressure of the air chamber.

It is not possible to apply, to such an inkjet printer, the technique of Patent Literature 1 that changes the content of processing by the recovery unit (maintenance unit) for each type of ink based on ink information, and thus it has not been possible to appropriately perform maintenance such as a purge operation. On condition that pieces of information of all types of ink are integrated into a single parameter, the parameter is not always set so as to allow purge operation to be appropriately performed on all the ink heads. Accordingly, there has been a possibility that purge operation cannot be appropriately performed on all the ink heads, resulting in insufficient purge operation, and thus an adverse effect on the image quality such as discharge failure is caused.

SUMMARY OF THE INVENTION

The present invention has been made in view of the above problem. An object of the present invention is to provide an inkjet printer which is capable of performing maintenance appropriately on all of a plurality of inkjet heads, when performing the maintenance operation by using a maintenance unit common to the plurality of inkjet heads.

According to one aspect of the present invention, there is provided, in order to achieve the aforementioned object, an inkjet printer including a main body device that performs printing by discharging ink from a plurality of inkjet heads, and ink cartridges detachably mounted on the main body device, the inkjet printer including: a maintenance unit configured to simultaneously perform a maintenance operation on the plurality of inkjet heads; a storage unit configured to store, for each type of ink discharged from the plurality of inkjet heads, a manufacturing date or a start-of-use date of the ink cartridge, a normal consumption period from the manufacturing date or the start-of-use date of the ink cartridge to a recommended time limit before the expiration date, cycle and strength of a maintenance operation performed by the maintenance unit before the recommended time limit, and cycle and strength of the maintenance operation performed by the maintenance unit after the recommended time limit; a determination unit configured to determine whether or not the recommended time limit of the ink cartridge has passed, based on the manufacturing date or the start-of-use date and the normal consumption period stored in the storage unit, and an elapsed period from the manufacturing date or the start-of-use date of the ink cartridge; a maintenance setting value decision unit configured to select and decide, in a case where the determination unit determines that the recommended time limit has passed, the shortest cycle and the strongest strength as maintenance setting values for the maintenance unit configured to simultaneously perform the maintenance operation on the plurality of inkjet heads, from among (i) the cycle and the strength of the maintenance operation performed by the maintenance unit before the recommended time limit stored in the storage unit corresponding to the ink cartridge whose recommended time limit is determined to have not passed by the determination unit, and (ii) the cycle and the strength of the maintenance operation performed by the maintenance unit after the recommended time limit stored in the storage unit corresponding to the ink cartridge whose recommended time limit is determined to have passed by the determination unit; and a controller configured to cause the maintenance unit to execute the maintenance operation, based on the maintenance setting values decided by the maintenance setting value decision unit.

According to one aspect of the invention, the inkjet printer further includes a thermometer that detects use-environment temperature of the inkjet printer; and a period change unit configured to change the normal consumption period stored in the storage unit, based on the temperature detected by thermometer, and an elapsed time from when the ink cartridge is mounted on the main body device.

According to one aspect of the present invention, the inkjet printer further includes a correction coefficient storage unit configured to store, for each type of sheet on which the ink is discharged, a correction coefficient of the cycle in association with a correction coefficient of the strength; and a setting value correction unit configured to extract, from the correction coefficient storage unit, a correction coefficient of the cycle and a correction coefficient of the strength corresponding to the specified type of sheet, and to correct the maintenance setting values decided by the maintenance setting value decision unit with the extracted correction coefficient, wherein the controller causes the maintenance unit to execute the maintenance operation, based on the maintenance setting values decided by the maintenance setting value decision unit and corrected by the setting value correction unit.

According to one aspect of the invention, the determination unit determines whether or not the recommended time limit of the ink cartridge has passed, based on the manufacturing date or the start-of-use date and the normal consumption period stored in the storage unit, and the elapsed period from the manufacturing date or the start-of-use date of the ink cartridge. The maintenance setting value decision unit selects and decides, in a case where the determination unit determines that the recommended time limit has passed, the shortest cycle and the strongest strength as maintenance setting values for the maintenance unit configured to simultaneously perform the maintenance operation on the plurality of inkjet heads from among (i) the cycle and the strength of the maintenance operation performed by the maintenance unit before the recommended time limit stored in the storage unit corresponding to the ink cartridge whose recommended time limit is determined to have not passed by the determination unit, and (ii) the cycle and the strength of the maintenance operation performed by the maintenance unit after the recommended time limit stored in the storage unit corresponding to the ink cartridge whose recommended time limit is determined to have passed by the determination unit. The controller causes the maintenance unit to execute the maintenance operation based on the maintenance setting values decided by the maintenance setting value decision unit.

Accordingly, when performing a maintenance operation by using maintenance unit common to a plurality of inkjet heads, the shortest period and the strongest strength can be selected and decided as the maintenance setting value. Therefore, it is possible to set maintenance setting values for performing the maintenance operation appropriately on all the inkjet heads. Thereby, it is possible to prevent insufficient purge operation of any of the inkjet heads and perform the maintenance operation appropriately on all the inkjet heads.

According to one aspect of the invention, the period change unit changes the normal consumption period stored in the storage unit based on the temperature detected by a thermometer and the elapsed time from when the ink cartridge was mounted on the main body device, and therefore it is possible to set an appropriate normal consumption period when the ink has significantly deteriorated due to high use-environment temperature, or when the ink has not deteriorated very much because of low use-environment temperature.

According to one aspect of the invention, the controller causes the maintenance unit to execute the maintenance operation based on the maintenance setting values decided by the maintenance setting value decision unit and corrected by the setting value correction unit, and thus it is possible to set appropriate maintenance setting values corresponding to the type of sheet.

Sheets are transferred from the tray by a rotating transfer roller. At this time, paper dust may be generated due to the influence of slipping, or the like, of the transfer roller. The amount of paper dust generated differs depending on the type of sheet. The larger the amount of paper dust generated is, the larger the amount of paper dust floating inside the printer becomes. Attachment of the floating paper dust to a nozzle of the inkjet head may cause clogging. Therefore, the larger the amount of paper dust generated is, the more necessary it is to shorten the cycle of performing a purge operation and to increase the strength of purge operation.

In addition, when ink lands on the sheet, the degree of bleeding differs depending on the type of sheet. In the case a sheet prone to bleeding, the ink having landed spreads in a bleeding manner even when there is generated an ink landing position deviation referred to as a so-called misdirection, and thus the ink landing position deviation is hardly conspicuous. Accordingly, the influence of landing position deviation is small in the case of a sheet prone to bleeding. On the other hand, in the case of a sheet with less bleeding, an ink landing deviation is more conspicuous when the deviation is generated and thus landing position deviation has a larger influence. Therefore, the smaller the bleeding is, the more necessary it is to shorten the cycle of performing a purge operation and to increase the strength of purge operation.

Accordingly, it is possible to set appropriate maintenance setting values according to the type of sheet, for example, amount of paper dust generated or easiness of bleeding, and thus the maintenance operation can be performed by using an appropriate period and strength.

BRIEF DESCRIPTION OF THE DRAWINGS

FIG. 6 illustrates an example of a cycle correction coefficient and a strength correction coefficient.

FIG. 7 illustrates an example of a period correction coefficient.

DESCRIPTION OF THE EMBODIMENTS

Hereinafter, embodiments of the present invention will be described with reference to the drawings.

In the present embodiment, the description will be made taking, as an example, an inkjet printer that simultaneously performs a purge operation on inkjet heads corresponding to inks of C (cyan), M (magenta), Y (yellow), and K (black).

<Configuration of Inkjet Printer>

Figure 1:
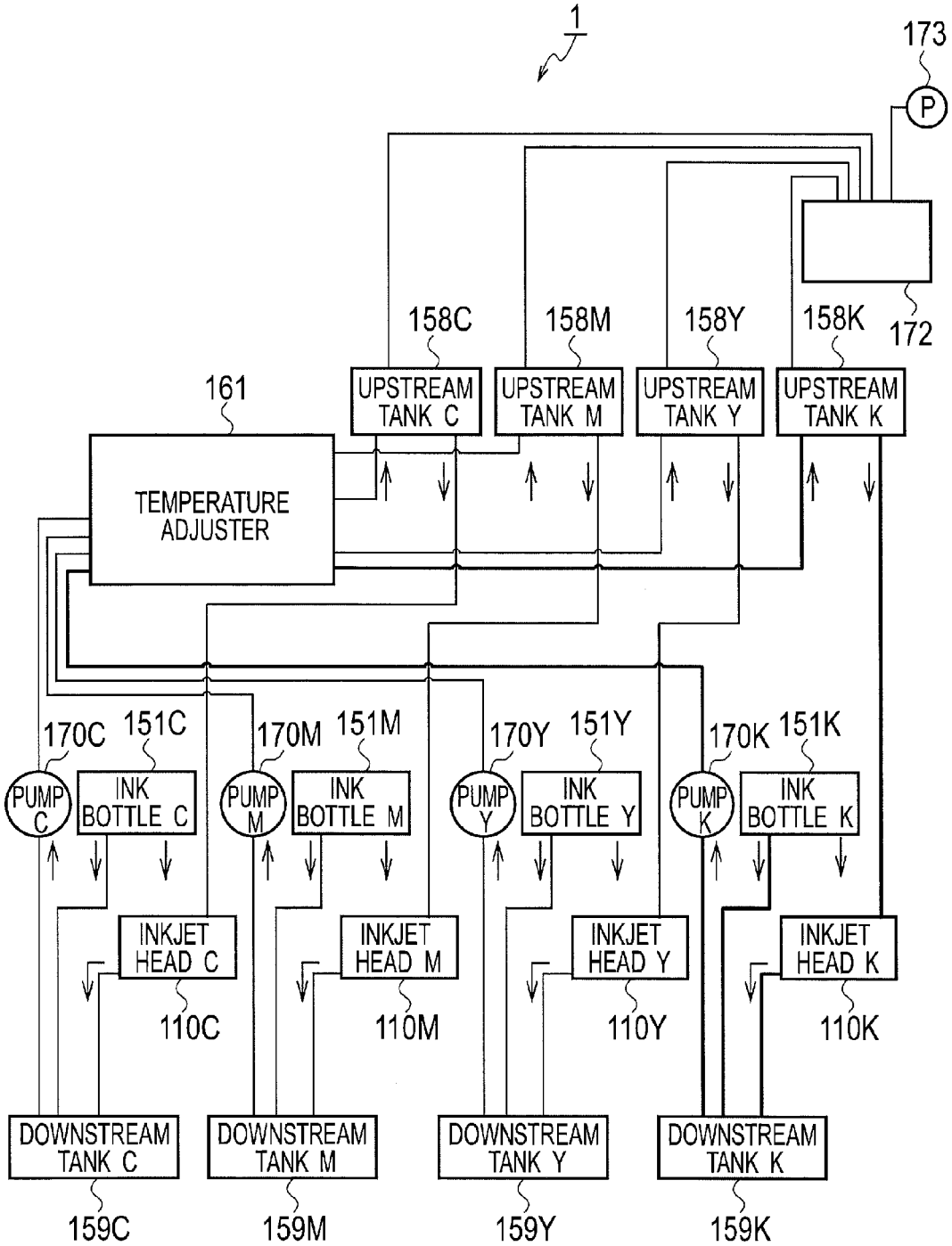
FIG. 1 is a drawing explaining a configuration of an inkjet printer according to an embodiment of the present invention.

FIG. 1 is a drawing explaining a configuration of an inkjet printer 1.

As illustrated in FIG. 1, the inkjet printer 1 includes inkjet heads 110C, 110M, 110Y and 110K corresponding to the inks of C (cyan), M (magenta), Y (yellow) and K (black). After a sheet has been transferred by a transfer roller inside the printer, printing on the sheet is performed line-by-line through the use of ink discharged from the inkjet heads 110C, 110M, 110Y and 110K while the sheet is being transferred at a speed determined in a print condition, by a looped transfer belt (not illustrated) provided on each of opposite surfaces of the inkjet heads 110C, 110M, 110Y and 110K.

Each color of ink is supplied from a detachable ink bottle. The inkjet printer 1 includes an ink bottle 151C that supplies ink of C (cyan), an ink bottle 151M that supplies ink of M (magenta), an ink bottle 151Y that supplies ink of Y (yellow), and an ink bottle 151K that supplies ink of K (black). The following description will be made taking the ink bottle 151 as a representative when the ink color is not of importance. The same applies to other function units.

The ink supplied from the ink bottle 151 passes through an ink circulation path formed of a pipe made of resin, metal, or the like, and is temporarily stored in a downstream tank provided on the downstream side of the inkjet head 110. Accordingly, the inkjet printer 1 is provided with a downstream tank 159C that stores the ink of C (cyan), a downstream tank 159M that stores the ink of M (magenta), a downstream tank 159Y that stores the ink of Y (yellow), and a downstream tank 159K that stores the ink of K (black).

The ink stored in the downstream tank 159 is sent, by a pump, to an upstream tank provided on the upstream side of the inkjet head 110. Accordingly, the inkjet printer 1 is provided with a pump 170C, a pump 170M, a pump 170Y, and a pump 170K, and an upstream tank 158C, an upstream tank 158M, an upstream tank 158Y, and an upstream tank 158K. The ink sent to the upstream tank 158 is fed to the inkjet head 110 having a large number of nozzles that discharge ink.

The ink which has not been discharged from the inkjet head 110 is returned to the downstream tank 159. The return of ink from the upstream tank 158 to the downstream tank 159 via the inkjet head 110 utilizes the water head difference between the upstream tank 158 and the downstream tank 159.

A common air chamber 172 is connected to the upstream tank 158. A pump 173 provided in the common air chamber 172 sends air to the upstream tank 158.

A temperature range in which the print quality is assured is defined in the case of ink. When the environmental temperature is low and the ink temperature is below the lower limit temperature which allows printing, it is necessary to heat the ink. On the other hand, a driver or a piezoelectric element provided inside the inkjet head 110 generates heat by operating, and it is necessary to suppress the effect of the rise of ink temperature at the time of a high temperature due to the heat generation or Joule heat by vibration of ink. Therefore, a temperature adjuster 161 is provided on the ink circulation path. Ink is heated or cooled by the temperature adjuster 161.

Next, details of the ink circulation path circulating the ink discharged from the nozzles of the inkjet head and the purge operation using the ink circulation path will be described.

Figure 2:
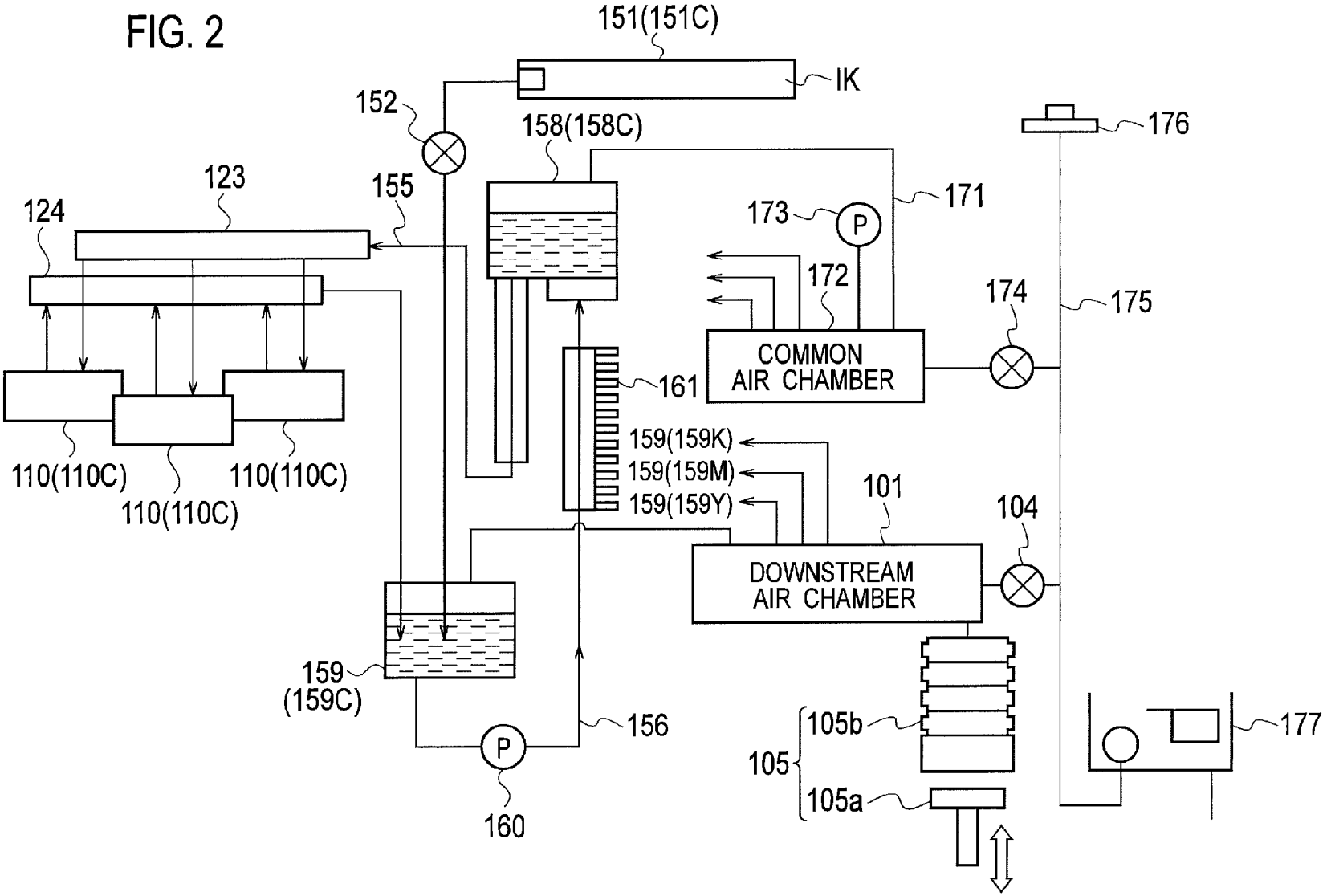
FIG. 2 schematically illustrates an ink circulation path circulating ink discharged from nozzles of an inkjet head in the inkjet printer according to the embodiment of the present invention.

FIG. 2 schematically illustrates an ink circulation path that circulates ink discharged from nozzles of an inkjet head in the inkjet printer 1. Note that, although the description will be made here taking the ink circulation path of the ink of C (cyan) as a representative, ink circulation paths of M (magenta), Y (yellow), and K (black) have a similar configuration.

As illustrated in FIG. 2, the inkjet printer 1 includes the upstream tank 158 storing ink IK, as described above. The upstream tank 158 and an ink supply chamber 123 provided on the upstream side of the inkjet head 110 which discharges ink are connected via an ink supply path 155.

An ink recovering chamber 124 provided on the downstream side of the inkjet head 110, the downstream tank 159 storing the ink IK recovered from the ink recovering chamber 124, a pump 160, the temperature adjuster 161, and the upstream tank 158 are connected via an ink recovering path 156. Accordingly, the ink stored in the downstream tank 159 is sent out to a side of the temperature adjuster 161 by activation of the pump 160.

An air communication path 171 is connected to the upstream tank 158. A common air chamber 172 connected to an air layer above the upstream tank 158 is provided via the air communication path 171.

An atmosphere release pipe 175 is connected to the common air chamber 172. The atmosphere release pipe 175 is provided with an atmosphere release valve 174. The inside of the common air chamber 172 is opened into the atmosphere by opening the atmosphere release valve 174. The common air chamber 172 can be sealed by closing the atmosphere release valve 174. The common air chamber 172 is provided with the pump 173 that sends air into in the common air chamber 172.

As described above, the common air chamber 172 is provided with the atmosphere release valve 174 and the pump 173, and thus the air pressure inside the common air chamber 172 can be regulated and the pressure of the air layer above the upstream tank 158 being in communication with the common air chamber 172 can be regulated.

The atmosphere release pipe 175 is provided with an air filter 176 that prevents air dust from entering the atmosphere release pipe 175, and an overflow pan 177 that recovers the ink which has overflown from the downstream tank 159 at the lower part of the atmosphere release pipe 175, and has flown into the atmosphere release pipe 175.

The downstream tank 159 is connected to the ink bottle 151 filled with the ink IK. Fresh ink IK stored in the ink bottle 151 is supplied to the downstream tank 159 by opening the ink supplying valve 152.

Note that, when the downstream tank 159 is maintained to atmospheric pressure, the height position of the downstream tank 159 is defined so as to provide an appropriate pressure at which meniscus is generated in the nozzles due to the water head difference between the downstream tank 159 and the nozzles of the inkjet head 110.

Therefore, when circulating the ink IK into the ink circulation path 157 formed by the ink supply path 155 and the ink recovering path 156, opening of the atmosphere release valve 174 provided in the common air chamber 172 causes the ink IK stored in upstream tank 158 to be supplied to the ink supply chamber 123 of the inkjet head unit through the ink supply path 155, due to the water head difference between the upstream tank 158 and the downstream tank 159. In addition, the ink IK is then distributed from the ink supply chamber 123 to a plurality of inkjet heads 110 arranged two-dimensionally, and the ink IK is selectively discharged on the sheet from each inkjet head 110.

There is provided a downstream-side common air chamber 101 being in communication with the air layer in the downstream tank 159. A pressure regulator 105 is connected to the downstream-side common air chamber 101. The bellows main body part 105*b* expands or contracts by raising or lowering a bellows-ascending/descending mechanism 105*a* of the pressure regulator 105. Accordingly, it is possible to regulate the internal pressure of the downstream-side common air chamber 101.

The atmosphere release pipe 175 is connected to the downstream-side common air chamber 101. The atmosphere release pipe 175 is provided with an atmosphere release valve 104. The inside of the downstream-side common air chamber 101 is opened into the atmosphere by opening the atmosphere release valve 104. In addition, the downstream-side common air chamber 101 can be sealed by closing the atmosphere release valve 104.

With the atmosphere release valve 104 closed, it is possible to perform a purge operation that raises the internal pressure of the downstream common air chamber 101, on the pressure regulator 105. Specifically, the downstream common air chamber 101 is insulated from the atmosphere and the pressure of the air layer in the downstream tank 159 being in communication with the downstream common air chamber 101 rises, whereby ink becomes less likely to flow from the ink recovering chamber 124 into the downstream tank 159. In addition, ink is pushed out of the nozzles of the inkjet head 110, and the ink remains on the nozzle surface of the inkjet head 110. Accordingly, it is possible to prevent drying and clogging of the nozzle surface of the inkjet head 110.

It becomes possible to control the strength of the purge operation by regulating the internal pressure of the downstream common air chamber 101 through raising or lowering the bellows-ascending/descending mechanism 105*a* of the pressure regulator 105.

Figure 3:
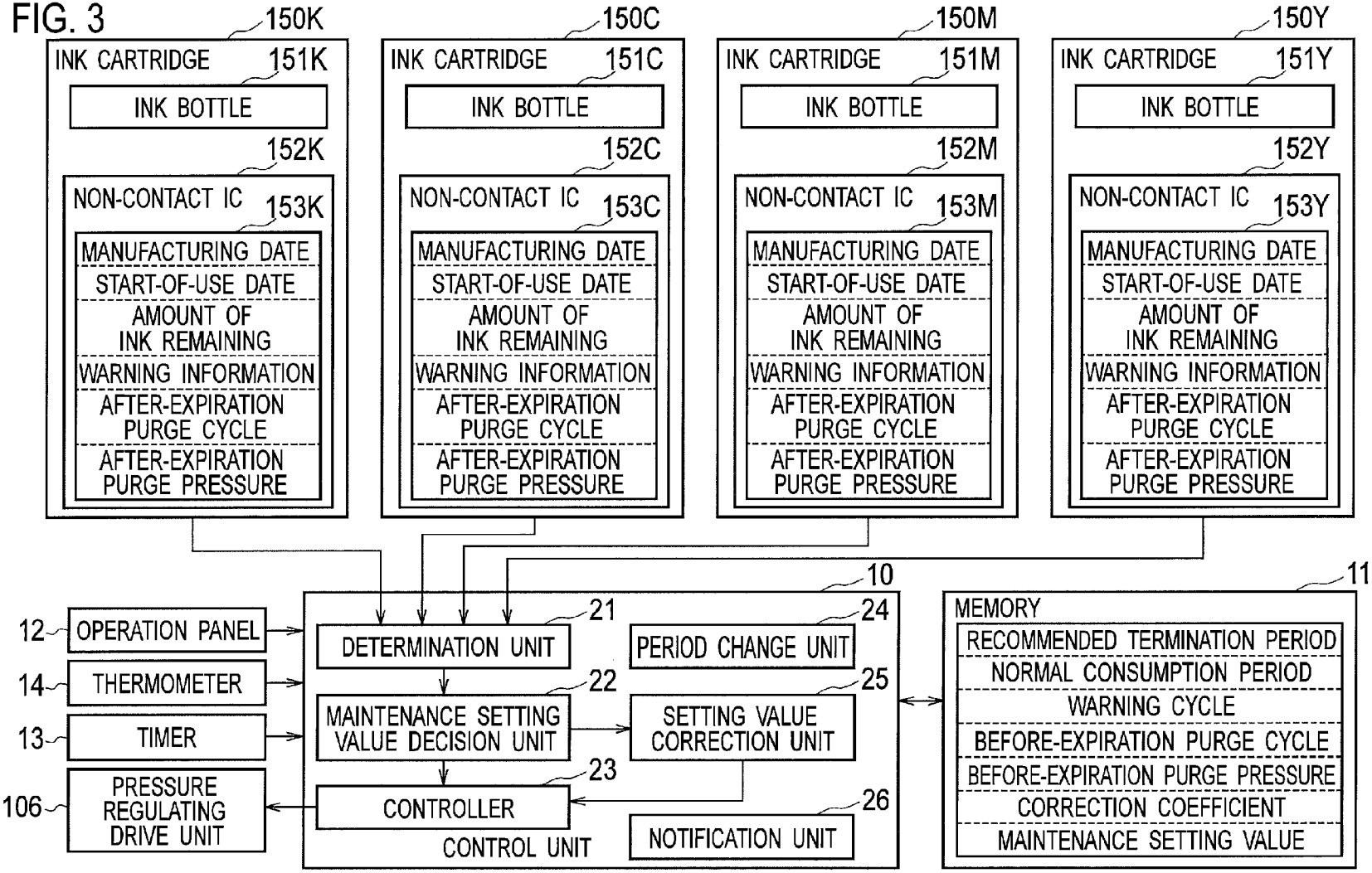
FIG. 3 is an explanatory diagram explaining a function of the inkjet printer according to the embodiment of the present invention.

FIG. 3 is an explanatory diagram of a function of the inkjet printer 1.

As illustrated in FIG. 3, the inkjet printer 1 includes ink cartridges 150K, 150C, 150M and 150Y, a control unit 10 provided in the main body device, a memory 11, an operation panel 12, a timer 13, and a pressure regulating drive unit 106.

The ink cartridge 150K corresponding to the ink of K (black) includes the ink bottle 151K and a non-contact IC (reference numeral 152K), respectively. Note that, although the ink cartridge 150K corresponding to the ink of K (black) is taken as an example in the description here, the same applies to other colors of ink.

The non-contact IC (reference numeral 152K), having a memory 153K, performs wireless data communication with the control unit 10 of the main body device.

The memory 153K stores therein a manufacturing date of the ink cartridge 150K, a start-of-use date when the ink cartridge 150K is mounted on the main body device, an amount of ink remaining in the ink bottle 151K, warning information indicating the date and time when a warning is issued, an after-expiration purge cycle indicating the cycle of performing a purge operation after the recommended time limit, and an after-expiration purge pressure indicating the purge pressure of purge operation after the recommended time limit. The cycle indicates how many sheets are to be printed before a purge operation is executed. The amount of ink remaining can be calculated by, for example, subtracting, from the initial amount, the amount discharged from the inkjet head 110. In addition, the warning information is set "null" (blank) as the initial value, and the date and time of the issuance of the warning is written for the first time when a warning is issued. Each time a warning is issued thereafter, the warning information is overwritten and updated by the date and time of issuance of the new warning. In addition, the ink cartridges 150C, 150M and 150Y corresponding to the inks of C (cyan), M (magenta), and Y (yellow) similarly has stored therein the manufacturing date, the amount of ink remaining, the warning information, the after-expiration purge cycle, and the after-expiration purge pressure, and performs wireless data communication with the control unit 10 of the main body device.

The memory 11 has stored therein, a normal consumption period indicating, for each of the ink cartridges 150K, 150C, 150M and 150Y, a period during which the ink cartridge can be normally used, and a recommended termination period during which the ink cartridge is usable but recommended to be replaced.

Figures 4, 5:
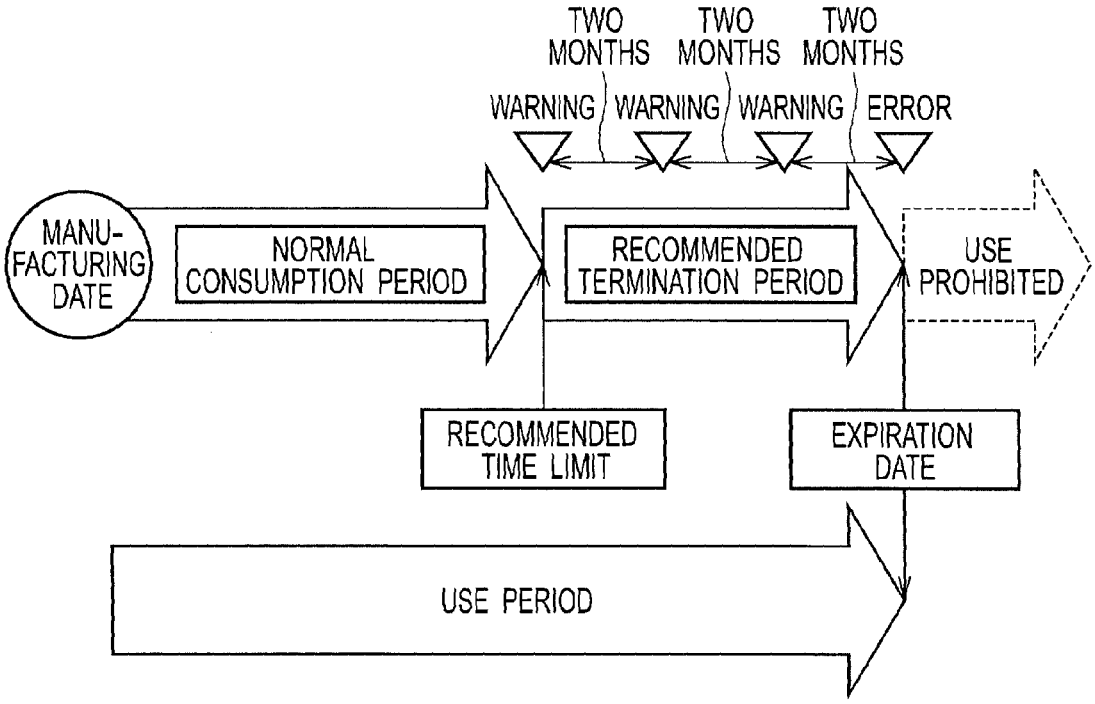
FIG. 4 illustrates an example of a normal consumption period and a recommended termination period stored in a memory of the inkjet printer according to the embodiment of the present invention.
FIG. 5 is a drawing explaining the normal consumption period and the recommended termination period.

FIG. 4 illustrates an example of a normal consumption period and a recommended termination period stored in the memory 11 of the inkjet printer 1.

As illustrated in FIG. 4, with regard to the normal consumption period 111, a setting range (month) 11*b* indicating a range in which the normal consumption period 111 can be set, a setting unit (month) 11*c* that is a unit capable of setting, and a default (month) 11*d* in the case of not carrying out setting are stored in association with each other, for each name 11*a* of the ink colors of C (cyan), M (magenta), Y (yellow) and K (black).

Similarly, with regard to the recommended termination period 112, a setting range (month) lib indicating the range in which the recommended termination period 112 can be set, a setting unit (month) 11*c* that is a unit capable of setting, and a default (month) 11*d* in the case of not carrying out setting are stored in association with each other, for each name 11*a* of the ink colors of C (cyan), M (magenta), Y (yellow) and K (black).

In addition, although not illustrated, the memory 11 has stored therein a warning cycle indicating the interval of issuing warnings. When, for example, a value equivalent to one or more integer multiples such as "2" (month) has been set, the warning cycle is supposed to issue warnings every two months. The bimonthly issuing will be described in detail later.

FIG. 5 is drawing explaining a normal consumption period and a recommended termination period.

As illustrated in FIG. 5, the memory of the non-contact IC has the manufacturing date stored therein, for each of the ink cartridges 150K, 150C, 150M and 150Y, and the recommended time limit is defined as a point of time at which the normal consumption period during which the ink cartridge can be used without any problem has passed from the manufacturing date. In addition, as will be described below, once the recommended time limit is passed, a period close to the expiration date is entered. During the recommended termination period during which the replacement of the ink cartridge is recommended, a warning is issued for each warning cycle (here, two months). The expiration date is a time point at which the recommended termination period has elapsed from the recommended time limit. The ink cartridge having passed the expiration date is no longer usable, and thus an error message is issued. The period from the manufacturing date to the expiration date serves as the use period.

The memory 11 has stored therein a before-expiration purge cycle which is a cycle of performing a purge operation before the recommended time limit and a before-expiration purge pressure which is the purge pressure of purge operation before the recommended time limit. With regard to the before-expiration purge cycle and the before-expiration purge pressure, the shortest cycle and the strongest strength are set before the recommended time limit, namely, during the entire normal consumption period for the maintenance units (pressure regulator 105 and pressure regulating drive unit 106) configured to simultaneously perform the maintenance operation on the plurality of inkjet heads 110C, 110M, 110Y and 110K. In addition, purge operation is then performed, based on the before-expiration purge cycle and the before-expiration purge pressure stored in the memory 11, before the recommended time limit, namely, during the normal consumption period.

The memory 11 has correction coefficients stored therein. Specifically, a cycle correction coefficient for correcting the cycle of performing a purge operation and a strength correction coefficient for correcting the strength of the purge operation are stored, for each type of sheet on which ink is discharged.

FIG. 6 illustrates an example of a cycle correction coefficient and a strength correction coefficient.

As illustrated in FIG. 6, the cycle correction coefficient and the strength correction coefficient are stored in association with each other, for each of the sheet types "mat paper", "ordinary paper" and "recycled paper".

Sheets are transferred from the tray by a rotating transfer roller. At this time, paper dust may be generated due to the influence of slipping, or the like, of the transfer roller. The amount of paper dust generated differs depending on the type of sheet. The larger the amount of paper dust generated is, the larger the amount of paper dust floating inside the printer becomes. Attachment of the floating paper dust to a nozzle of the inkjet head may cause clogging. Therefore, the larger the amount of paper dust generated is, the more necessary it is to shorten the cycle of performing a purge operation and to increase the strength (purge pressure) of purge operation.

In addition, when ink lands on the sheet, the degree of bleeding differs depending on the type of sheet. In the case a sheet prone to bleeding, the ink having landed spreads in a bleeding manner even when there is generated an ink landing position deviation referred to as a so-called misdirection, and thus the ink landing position deviation is hardly conspicuous. Accordingly, the influence of landing position deviation is small in the case of a sheet prone to bleeding. On the other hand, in the case of a sheet with less bleeding, an ink landing deviation is more conspicuous when the deviation is generated and thus landing position deviation has a larger influence. Therefore, the smaller the bleeding is, the more necessary it is to shorten the cycle of performing a purge operation and to increase the strength (purge pressure) of purge operation.

The cycle correction coefficient and the strength correction coefficient illustrated in FIG. 6 are preliminarily set as the cycle of performing a purge operation and the strength of the purge operation which are maintenance setting values decided by a maintenance setting value decision unit 22 described below, according to the amount of paper dust generated or easiness of bleeding. For example, mat paper with which a large amount of paper dust generated is unlikely to bleed, and thus the cycle correction coefficient is set to "0.8" and the strength correction coefficient is set to "1.1".

In addition, the memory 11 has stored therein a period correction coefficient as correction coefficients for changing the normal consumption period stored in the memory 11.

FIG. 7 illustrates an example of a period correction coefficient.

As illustrated in FIG. 7, a period correction coefficient corresponding to the temperature and the elapsed time is stored.

The period during which the ink sealed in the ink bottle 151 is usable may differ depending on the use-environment. Specifically, the higher the environment temperature is and the longer the use period under the use-environment temperature is, the more significantly the ink deteriorates. Therefore, it is desirable that the higher the use-environment temperature is, the shorter the normal consumption period is set.

Accordingly, for example, when the temperature is equal to or more than 10 (° C.) and less than 20 (° C.), the period correction coefficient is set to "1.0" so as not to change the normal consumption period. When the ink is being used for one (year) to 5 (years) in a use-environment with the temperature being equal to or higher than 30 (° C.) and lower than 40 (° C.), the period correction coefficient is set to "0.6" so as to shorten the normal consumption period.

Returning to FIG. 3, the maintenance setting values stored in the memory 11 have the before-expiration purge cycle and the before-expiration purge pressure stored as initial values. When a determination unit 21 described below determines that the recommended time limit has passed, the shortest cycle and the strongest strength are selected and set as maintenance setting values, for the maintenance unit configured to simultaneously perform the maintenance operation on the plurality of inkjet heads 110C, 110M, 110Y and 110K from among (i) the cycle and the strength of the maintenance operation performed by the maintenance units (pressure regulator 105 and pressure regulating drive unit 106) before the recommended time limit stored in the memory 11 corresponding to the ink cartridge whose recommended time limit is determined to have not passed by the determination unit 21, and (ii) the cycle and the strength of the maintenance operation performed by the maintenance unit after the recommended time limit stored in the memory 153 corresponding to the ink cartridge whose recommended time limit is determined to have passed by the determination unit 21.

The operation panel 12 constituted of an operation screen and a touch panel is connected to the control unit 10. The operation panel 12 is arranged on the upper part of the inkjet printer 1. The operation panel 12 can be used as an input operation unit to which a user inputs setting conditions including the content of processing such as the number of sheets to be printed when copy-printing a printed image set on a scanner unit (not illustrated), or when printing a print job accepted from the outside.

The operation panel 12 accepts setting operations of a recommended time limit, a warning cycle and the like, based on user operation. The control unit 10 reflects the setting operation in the memory 11.

The timer 13, connected to the control unit 10, acquires the manufacturing date stored in the non-contact IC via the control unit 10, and measures the elapsed period from the manufacturing date for each of the ink cartridges 150K, 150C, 150M and 150Y.

Thermometer 14 measures the use-environment temperature of the inkjet printer 1.

The pressure regulating drive unit 106 raises or lowers the bellows ascending/descending mechanism 105*a* of the pressure regulator 105, based on an instruction from the control unit 10. Accordingly, the bellows main body part 105*b* expands or contracts, and thus the internal pressure of the downstream common air chamber 101 can be regulated.

The control unit 10 which causes the inkjet heads 110C, 110M, 110Y and 110K to perform printing operation is an arithmetic processing unit constituted of hardware such as a processor such as a CPU or a DSP, a memory, and other electronic circuits or software such as programs having the functions of the hardware; or a combination thereof. The control unit 10 has a function of performing wireless data transfer from and to the ink cartridges mounted on the main body device. Furthermore, the control unit 10 detects supply of power to the inkjet printer 1 or return from the power saving mode. Here, the power saving mode is a mode not capable of displaying the warning screen described below by suppressing power consumption, such as, for example, the sleep mode obtained by suppressing power consumption. The return from the power saving mode refers to transition from the sleep mode to the normal mode in which printing is possible.

In addition, the control unit 10 virtually constructs various types of function modules by reading and executing programs as appropriate, and performs processing relating to image data, operation control of each part, and various processing on user operation. Specifically, the control unit 10 has constructed therein function modules of the determination unit, the maintenance setting value decision unit, the controller, the period change unit, and the setting value correction unit. Note that the "module" used in the present embodiment is constituted of hardware such as apparatuses or devices, software having the functions of the hardware, a combination thereof or the like, and refers to a functional unit for realizing a predetermined operation.

The determination unit 21 determines whether or not the ink cartridge 150 has passed the recommended time limit, based on the manufacturing date or the start-of-use date stored in the memory 153, the normal consumption period stored in the memory 11, and the elapsed period from the manufacturing date or the start-of-use date of the ink cartridge 150.

The maintenance setting value decision unit 22 selects and decides, in the case where the determination unit 21 determines that the recommended time limit has passed, the shortest cycle and the strongest strength, as maintenance setting values for the maintenance units (pressure regulator 105 and pressure regulating drive unit 106) configured to simultaneously perform the maintenance operation on the plurality of inkjet heads 110C, 110M, 110Y and 110K from among (i) the before-expiration purge cycle and the before-expiration purge pressure stored in the memory 11 corresponding to the ink cartridge whose recommended time limit is determined to have not passed by the determination unit 21, and (ii) the after-expiration purge cycle and the after-expiration purge pressure stored in the memory 153 corresponding to the ink cartridge whose recommended time limit is determined to have passed by the determination unit 21.

The controller 23 causes the maintenance unit (the pressure regulator 105 and pressure regulating drive unit 106) to perform the maintenance operation, based on the maintenance setting values decided by the maintenance setting value decision unit 22. Specifically, when the number of printed sheets reaches the cycle specified by the maintenance setting value, the controller 23 causes the maintenance units (pressure regulator 105 and pressure regulating drive unit 106) to perform the maintenance operation at the purge pressure (strength) specified by the maintenance setting value.

A period change unit 24 changes the normal consumption period stored in the memory 11, based on the temperature detected by thermometer 14 and the elapsed time from when the ink cartridge 150 is mounted on the main body device.

The setting value correction unit 25 extracts, from the memory 11, correction coefficients of the cycle and the strength corresponding to the specified type of sheet, and corrects, with the extracted correction coefficient, the maintenance setting values decided by the maintenance setting value decision unit 22.

A notification unit 26 displays, as a warning on the operation panel 12, a message indicating that the expiration date of an ink cartridge is close, when the determination unit 21 determines that the recommended time limit has passed and also the inkjet printer 1 has been powered on, or has returned from the power saving mode, and a predetermined condition is satisfied. Specifically, the notification unit 102 displays, as a warning on the operation panel 12, a message indicating that the expiration date of the ink cartridge is close when no warning information is stored in the memory 153K of the ink cartridge 150K. In addition, the notification unit 102 displays, as a warning on the operation panel 12, a message indicating that the expiration date of the ink cartridge is close when the warning information is stored in the memory 153K of the ink cartridge 150K and also only one warning cycle has elapsed from the time point of the issuance of the warning.

<Action of Inkjet Printer>

Next, an action of the inkjet printer 1 will be described.

Figure 8:
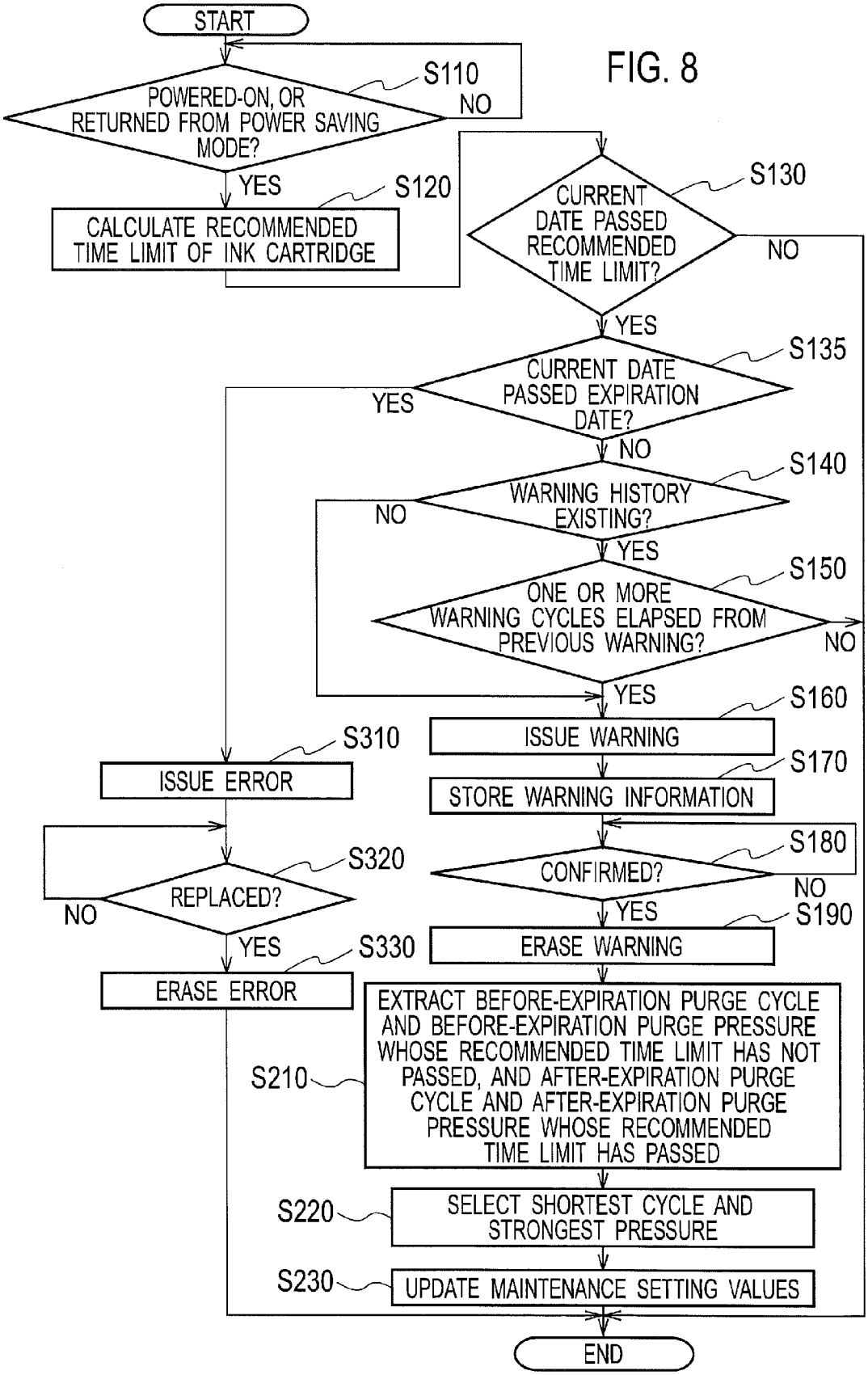
FIG. 8 is a flowchart illustrating a processing procedure in the inkjet printer according to the embodiment of the present invention.

FIG. 8 is a flowchart illustrating a processing procedure in the inkjet printer 1. Note that, although the ink of K (black) is taken as an example in the description here, the same also applies to other colors of ink.

As illustrated in FIG. 8, when the power-on switch of the main body device is pressed down by the user, or when a return from the power saving mode is detected (YES in step 5110), the inkjet printer 1 firsts starts wireless communication with the non-contact IC (reference numeral 152K) of the ink cartridge 150K, and acquires the manufacturing date stored in the memory 153K of the ink cartridge 150K.

In addition, the determination unit 21 then calculates the recommended time limit of the ink cartridge 150K (step S120), based on the manufacturing date acquired via wireless communication and the recommended termination period of the ink cartridge 150K stored in the memory 11.

Next, the determination unit 21 determines whether or not the current date of the ink cartridge 150K has passed the recommended time limit (step S130), based on the manufacturing date stored in the memory 153K of the ink cartridge 150K, the recommended time limit of the ink cartridge 150K, and the elapsed period time from the manufacturing date of the ink cartridge 150K measured by the timer 13.

When it is determined at step S130 that the current date has not passed the recommended time limit (NO), it is still within the normal consumption period and therefore the processing is completed without issuing a warning.

On the other hand, when it is determined at step S130 that the current date has passed the recommended time limit (YES), the determination unit 21 determines whether or not the current date has passed the expiration date (step S135).

When, it is determined at step S135 that the current day has not passed the expiration date (NO), whether or not there exists a warning history is determined by wirelessly accessing the memories 153K to 153Y (step S140). As described above, the warning information is set to "null" (blank) as the initial value, and the date and time of the issuance of the warning is written as the warning information for the first time when a warning is issued. Accordingly, existence of a warning history indicates that a warning has been previously issued, whereas absence of a warning history indicates that a warning has never been issued.

When it is determined at step S140 that there exists a warning history (YES), it suggests that a warning has been previously issued and therefore the notification unit 102 determines whether or not a cycle exceeding a warning cycle has elapsed from the time point of the issuance of the previous warning (step S150), based on the warning history (warning information). For example, when a warning cycle is set to be "2" (months), it is determined whether or not the month of the current date is two months after the month of a time point of the issuance of the previous warning.

When it is determined at step S150 that a cycle exceeding a warning cycle has not elapsed from the time point of the issuance of the previous warning (NO), the processing is completed without issuing a warning in order to reduce the annoyance for the user due to the warning display, and without changing the maintenance setting values (cycle of performing a purge operation and strength of purge operation).

On the other hand, when it is determined at step S150 that a cycle exceeding a warning cycle has elapsed from the time point of the issuance of the previous warning (YES), it can be estimated that a period has passed from the time point of the issuance of the previous warning to a degree which is not annoying for the user, and thus the notification unit 26 causes the operation panel 12 to display, as a warning, for example, a message indicating that the expiration date of the ink cartridge is close (step S160).

Next, the notification unit 102 stores the warning information in the memory 153K of the ink cartridge 150K (step S170). Specifically, when no warning information is stored in the memory 153K, in other words, when the warning information is "null" (blank), the notification unit 102 writes the date and time of the issuance of a warning as the warning information, for the first time. On the other hand, when warning information is stored in the memory 153K, the notification unit 26, overwrites and updates the stored warning information, with the latest date and time (most recent date and time) of issuing a warning, as the warning information.

In addition, when the user presses the OK button on the warning screen with respect to the operation panel 12 (YES in step S180), the notification unit 102 erases the warning being displayed on the operation panel 12 (step S190).

Then, the maintenance setting value decision unit 22 (i) extracts the before-expiration purge cycle and the before-expiration purge pressure, stored in the memory 11 corresponding to the ink cartridge whose recommended time limit is determined to have not passed by the determination unit 21, and (ii) extracts the after-expiration purge cycle and the after-expiration purge pressure, stored in the memory 153 corresponding to the ink cartridge whose recommended time limit is determined to have passed by the determination unit (step S210).

Furthermore, the maintenance setting value decision unit 22 selects and decides the shortest cycle and the strongest strength as maintenance setting values from among (i) the before-expiration purge cycle and the before-expiration purge pressure corresponding to the ink cartridge whose recommended time limit is determined to have not passed by the determination unit 21, and (ii) the after-expiration purge cycle and the after-expiration purge pressure corresponding to the ink cartridge whose recommended time limit is determined to have passed by the determination unit 21 (step S220). The maintenance setting value decision unit 22 overwrites and updates the maintenance setting values stored in the memory 11 (step S230).

Let us assume, for example, that the before-expiration purge cycle and the before-expiration purge pressure are set as maintenance setting values during the normal consumption period. With regard to the before-expiration purge cycle and the before-expiration purge pressure, the shortest cycle and the strongest strength are set as maintenance setting values during the normal consumption period for the maintenance units (pressure regulator 105 and pressure regulating drive unit 106) configured to simultaneously perform the maintenance operation on the plurality of inkjet heads 110C, 110M, 110Y and 110K.

In such a case, when the recommended time limit of M (magenta) has passed, the before-expiration purge cycle and the before-expiration purge pressure are read from each of the memories 153C, 153Y and 153K of the ink cartridges 150C, 150Y and 150K respectively corresponding to the C (cyan), Y (yellow) and K (black) whose recommended time limits have not passed, and also the after-expiration purge cycle and the after-expiration purge pressure are read from the memory 153M of the ink cartridge 150M.

In addition, there are set the after-expiration purge cycle and the after-expiration purge pressure of the M (magenta), which are the shortest cycle and the strongest strength among the before-expiration purge cycles and the before-expiration purge pressures respectively of C (cyan), Y (yellow) and K (black), and the after-expiration purge cycle and the after-expiration purge pressure of M (magenta), which have been read-out.

Accordingly, it is possible to select and decide the shortest cycle and the strongest strength as maintenance setting values when performing a maintenance operation (purge operation) on the plurality of inkjet heads 110C, 110M, 110Y and 110K by common maintenance units (pressure regulator 105 and pressure regulating drive unit 106). Therefore, it is possible to set maintenance setting values for appropriately performing a maintenance operation (purge operation) on all the inkjet heads 110C, 110M, 110Y and 110K. Consequently, it is possible to prevent insufficient purge operation of any of the inkjet heads, and appropriately perform the maintenance operation on all the inkjet heads 110.

In addition, the maintenance setting values may be corrected according to the type of sheet when performing printing processing.

As described above, it is desirable to change the cycle of performing a purge operation or the strength of the purge operation with regard to the sheet, according to the amount of paper dust generated or easiness of bleeding.

Accordingly, the setting value correction unit 25 may extract, from the memory 11, correction coefficients of the cycle and the strength which have been set and which correspond to the type of sheet, and may correct the maintenance setting value stored in the memory 11 by using the extracted correction coefficient.

Figure 9:
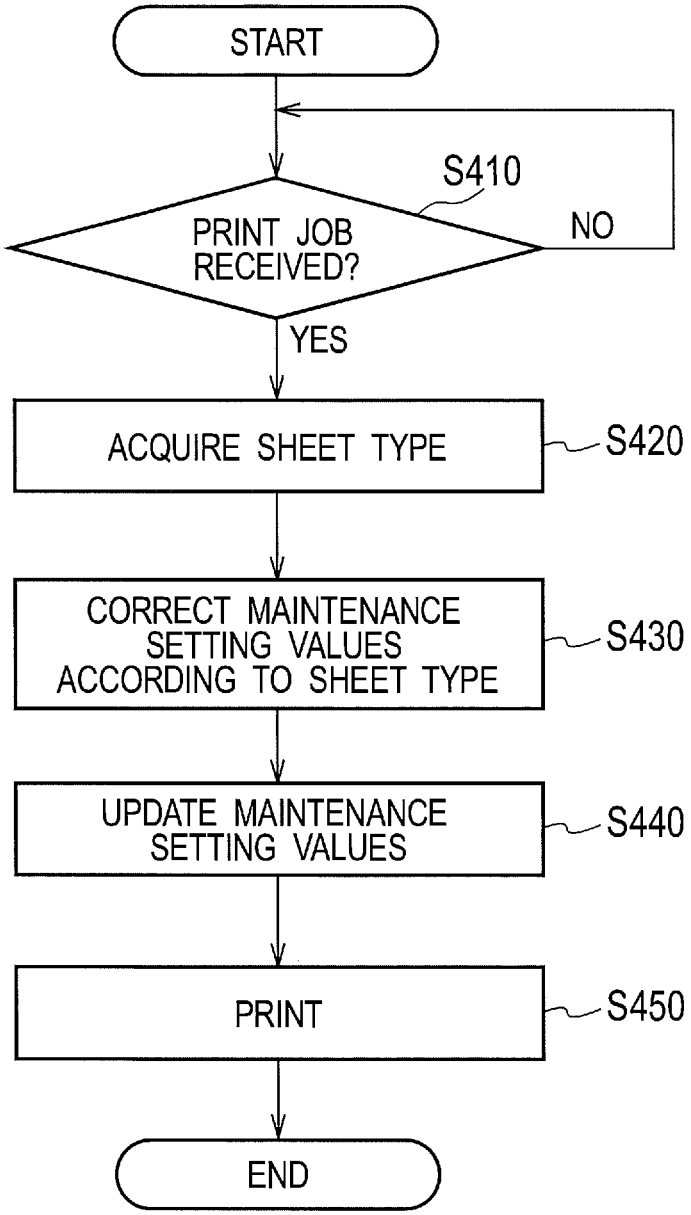
FIG. 9 is a flowchart illustrating a procedure of a maintenance setting value correction processing in the inkjet printer according to the embodiment of the present invention.

FIG. 9 is a flowchart illustrating a procedure of maintenance setting value correction processing in the inkjet printer 1. Note that, although the ink of K (black) is taken as an example in the description here, the same also applies to other colors of ink.

As illustrated in FIG. 9, when receiving a print job via a network or the like which is not illustrated (step S410), the sheet type is extracted from a header included in the print job (step S420). Here, when there is no information of the sheet type in the header, a sheet type may be extracted for a tray specified by the print job, based on a table preliminarily stored in the inkjet printer 1, by associating trays having sheets placed thereon with sheet types.

Next, the setting value correction unit 25 corrects maintenance setting values according to the type of sheet (step S430). Specifically, the setting value correction unit 25 reads correction coefficients according to the type of sheet from the memory 11, and, by using the read correction coefficients (cycle correction coefficient and strength correction coefficient), corrects the cycle of performing a purge operation and the strength of the purge operation, which are the maintenance setting values, decided by the maintenance setting value decision unit 22 and stored in the memory 11.

Setting value correction unit 25 then overwrites and updates the maintenance setting value stored in the memory 11 (step S440) by using the maintenance setting value corrected at step S430, and the control unit 10 performs printing based on the print job (step S450).

As described above, the setting value correction unit 25 extracts, from the memory 11, the correction coefficients of the cycle and the strength corresponding to the specified type of sheet, and corrects the maintenance setting value decided by the maintenance setting value decision unit 22 by using the extracted correction coefficient, whereby it is possible to set appropriate maintenance setting values according to, for example, the amount of paper dust generated or easiness of bleeding.

Furthermore, as described above, the higher the use-environment temperature of the ink sealed in the ink bottle 151 is, the more significantly the ink deteriorates. Accordingly, it may also be conceivable that the higher the use-environment temperature is, the shorter the normal consumption period is set.

Specifically, the period change unit 24 changes the normal consumption period stored in the memory 11, based on the temperature (use-environment temperature) detected by thermometer 14 and the elapsed time counted by the timer 13 from when the ink cartridge 150 is mounted on the main body device.

For example, assuming that the elapsed time counted by the timer 13 from when the ink cartridge 150 is mounted on the main body device is 0.6 (years), and the average temperature detected by thermometer 14 during that period is a value within a range between 0 (° C.) and 10 (° C.), the period change unit 24 extracts, from the memory 11, a period correction coefficient "1.1" corresponding to an elapsed time of Y 0 (year) to 1 (year), and a temperature of T 0 (° C.) to (° C.).

In addition, the period change unit 24 then changes the normal consumption period by multiplying the normal consumption period stored in the memory 11 by the extracted value "1.1".

Accordingly, it is possible to set an appropriate normal consumption period even when the use-environment temperature is high and thus the ink is significantly deteriorated, or even when the use-environment temperature is low and thus the ink is not significantly deteriorated.

In addition, although an inkjet printer that simultaneously performs a purge operation on inkjet heads corresponding to the inks of C (cyan), M (magenta), Y (yellow), and K (black) is taken as an example in the description with regard to the inkjet printer 1, the present invention is not limited thereto.

For example, the inkjet printer 1 may have an inkjet head which discharges clear ink which is a type of functional ink, and independently perform a purge operation on the clear inkjet head via a system independent of the inkjet heads corresponding to the inks of C (cyan), M (magenta), Y (yellow) and K (black).

Although C (cyan), M (magenta), Y (yellow) and K (black) have ink characteristics similar to each other, the clear ink which is a type of functional ink has ink characteristics that easily dries compared with the inks of C (cyan), M (magenta), Y (yellow) and K (black). Therefore, connecting the inkjet head that discharges the clear ink to a common air chamber or s downstream-side common air chamber common to the inkjet heads of C (cyan), M (magenta), Y (yellow) and K (black) to thereby simultaneously perform a purge operation leads to performing a purge operation always based on the maintenance setting values corresponding to the clear ink, which may result in performing a purge operation on C (cyan), M (magenta), Y (yellow) and K (black) to a more-than-necessary extent.

Therefore, purge operation is independently performed on the clear inkjet head via a system independent of the inkjet heads corresponding to the inks of C (cyan), M (magenta), Y (yellow) and K (black).

Specifically, the inkjet printer 1 may include: a clear ink cartridge detachably mounted on the main body device and having clear ink sealed therein; a clear inkjet head configured to discharge the clear ink sealed in the ink cartridge; maintenance units (pressure regulator and pressure regulating drive unit) configured to perform the maintenance operation (purge operation) on the clear inkjet head; and a memory that stores cycle and strength of a maintenance operation of the clear ink cartridge performed by the maintenance unit, a manufacturing date or a start-of-use date of the clear ink cartridge, and a normal consumption period to the recommended time limit before the expiration date of the clear ink cartridge. In addition, it may be possible that: the determination unit 21 is configured to determine whether or not the clear ink cartridge has passed the recommended time limit, based on the manufacturing date or the start-of-use date of the clear ink cartridge and the normal consumption period stored in memory, and an elapsed period from the manufacturing date or the start-of-use date; and when the determination unit 21 determines that the recommended time limit has passed, the maintenance setting value decision unit 22 is configured to read the cycle and the strength of the maintenance operation of clear ink from the memory and to decide the read-out cycle and strength as maintenance setting values; and the controller 23 is configured to cause the maintenance unit to execute the maintenance operation, based on the maintenance setting values decided by the maintenance setting value decision unit 22.

Accordingly, it is possible to independently perform a purge operation on the clear inkjet head via a system independent of the inkjet heads corresponding to the inks of C (cyan), M (magenta), Y (yellow) and K (black), and thus it is possible to perform the maintenance operation on all the inks of C (cyan), M (magenta), Y (yellow) and K (black), as well as clear ink, without performing a purge operation for C (cyan), M (magenta), Y (yellow) and K (black) to a more-than-necessary extent.

Note that, in the inkjet printer 1, (i) the memory 153 is provided for each of the ink cartridges 150K, 150C, 150M and 150Y, (ii) the memory 153 has stored therein a manufacturing date of the ink cartridge 150, a start-of-use date when the ink cartridge 150 is mounted on the main body device, amount of ink remaining stored in the ink bottle 151, warning information indicating the date and time of the issuance of a warning, an after-expiration purge cycle, and an after-expiration purge pressure, and (iii) the memory 11 on the main body side has stored therein a warning cycle, a before-expiration purge cycle, a before-expiration purge pressure, correction coefficients, maintenance setting values, a normal consumption period indicating, for each of the ink cartridges 150K, 150C, 150M and 150Y, a period during which the ink cartridge 150 can be normally used, and a recommended termination period during which the ink cartridge 150 is recommended to be replaced. However, the present invention is not limited thereto.

The manufacturing date, the start-of-use date, the amount of ink remaining, the warning information, the after-expiration purge cycle, the after-expiration purge pressure, the normal consumption period, the recommended termination period, the warning cycle, the before-expiration purge cycle, the before-expiration purge pressure, the correction coefficients, the maintenance setting values may all be stored in the memory 11, or maybe stored in the memory 153. In addition, the aforementioned various data may be respectively stored in the memory 11, or may be stored in the memory 153. Furthermore, in which of the memory 11 or 153 the aforementioned data is to be stored may be arbitrarily selected by the time of shipping.

Moreover, the notification unit 102 in the inkjet printer 1 causes the operation panel 12 to display, as a warning, a message indicating that the expiration date of the ink cartridge is close, in the case where it is determined by the determination unit 21 that the recommended time limit has passed, and in the case where as much as one warning cycle has passed from the time point of warning when the warning is previously issued and the inkjet printer 1 is powered on, based on the warning information stored in the memory 153K of the ink cartridge 150K and the warning cycle stored in the memory 11. However, the warning is not limited to presentation on the operation panel 12 and may be provided with, for example, an audio speaker, and the content of the warning from the voice loud speaker may be audio-output.

In addition, in the inkjet printer 1, the time point at which the normal consumption period has passed from the manufacturing date is defined as the recommended time limit, and the time point when only the recommended termination period has passed from the recommended time limit is calculated as the expiration date. However, the present invention is not limited thereto. For example, a period obtained by multiplying the warning cycle by a predetermined number of times (e.g., five) is defined as the recommended termination period, and the time point at which only the recommended termination period has passed from the recommended time limit maybe calculated as the expiration date. Furthermore, it may also be possible for the user to change settings of the expiration date according to the use-environment.

Furthermore, the expiration date may be calculated by adding a quality assurance period during which the quality is assured to the manufacturing date. In addition, the expiration date may set, by a calculation from the manufacturing date, as the time limit to which the quality of ink stored in the ink cartridge is assured, and a time limit traced back by the recommended termination period from the expiration date may be set as the recommended time limit.

Note that the effect of the invention can also be exerted even when the ink cartridge 150 mounted on the inkjet printer 1 is newly mounted on another inkjet printer 1.

Specifically, when the ink cartridge 150 mounted on a different inkjet printer is newly mounted on another inkjet printer 1, a determination may be made whether or not the recommended time limit has passed, or whether or not only one notification cycle has passed from the time point of notification, through the utilization of the manufacturing date or the warning information stored in the memory 153.

At this time, when the warning cycle in the memory 11 of the main body device is changed, the warning cycle is used to perform the aforementioned notification process.

In addition, although the inkjet printer 1 includes a pressure regulator and a pressure regulating drive unit as maintenance units and a purge operation is taken as exemplary maintenance processing, the present invention is not limited thereto. It is sufficient that the maintenance processing is required to be simultaneously performed on a plurality of inkjet heads.

Furthermore, a precursor operation or a flushing operation which is capable of individually performing maintenance operations on a plurality of inkjet heads may be further performed. Note that the precursor operation refers to an operation of stirring ink in an inkjet head to thereby return the thickened ink to a normal state, by slightly oscillating the piezoelectric element in the inkjet head to the extent that the ink does not discharge from the nozzle. The flushing operation refers to discharging a very small amount of ink from the inkjet head.

Note that, depending on the ink sealed in the ink cartridge, there can be cases where the cycle of the maintenance operation performed by the maintenance units before the recommended time limit is shorter than the cycle of the maintenance operation performed by the maintenance units after the recommended time limit, or the strength of the maintenance operation performed by the maintenance units before the recommended time limit is stronger than the strength of the maintenance operation performed by the maintenance units after the recommended time limit from.

For example, when C (cyan) is a type of ink having such characteristics, a long cycle and a weak strength are selected for the ink of C (cyan) when a recommended time limit has passed.

In such a case, also when there exists a type of ink of a longer cycle and a weaker strength (e.g., M (magenta)) than the aforementioned ink, the shortest cycle and the strongest strength are selected among the aforementioned types of ink and decided as maintenance setting values, and thus a cycle and a strength after the recommended time limit corresponding to the ink of C (cyan) are selected. Accordingly, the present invention can also be applied when such a type of ink is employed.

What is claimed is:

1. An inkjet printer including a main body device that performs printing by discharging ink from a plurality of inkjet heads, and ink cartridges detachably mounted on the main body device, the inkjet printer comprising:

a maintenance unit configured to simultaneously perform a maintenance operation on the plurality of inkjet heads;

a storage unit configured to store, for each type of ink discharged from the plurality of inkjet heads, a manufacturing date or a start-of-use date of the ink cartridge, a normal consumption period from the manufacturing date or the start-of-use date of the ink cartridge to a recommended time limit before the expiration date, cycle and strength of a maintenance operation performed by the maintenance unit before the recommended time limit, and cycle and strength of the maintenance operation performed by the maintenance unit after the recommended time limit;

a determination unit configured to determine whether or not the recommended time limit of the ink cartridge has passed, based on the manufacturing date or the start-of-use date and the normal consumption period stored in the storage unit, and an elapsed period from the manufacturing date or the start-of-use date of the ink cartridge;

a maintenance setting value decision unit configured to select and decide, in a case where the determination unit determines that the recommended time limit has passed, the shortest cycle and the strongest strength as maintenance setting values for the maintenance unit configured to simultaneously perform the maintenance operation on the plurality of inkjet heads, from among (i) the cycle and the strength of the maintenance operation performed by the maintenance unit before the recommended time limit stored in the storage unit corresponding to the ink cartridge whose recommended time limit is determined to have not passed by the determination unit, and (ii) the cycle and the strength of the maintenance operation performed by the maintenance unit after the recommended time limit stored in the storage unit corresponding to the ink cartridge whose recommended time limit is determined to have passed by the determination unit; and a controller configured to cause the maintenance unit to execute the maintenance operation, based on the maintenance setting values decided by the maintenance setting value decision unit.

2. The inkjet printer according to claim 1, further comprising:

a thermometer that detects use-environment temperature of the inkjet printer; and a period change unit configured to change the normal consumption period stored in the storage unit, based on the temperature detected by thermometer, and an elapsed time from when the ink cartridge is mounted on the main body device.

3. The inkjet printer according to claim 1, further comprising:

a correction coefficient storage unit configured to store, for each type of sheet on which the ink is discharged, a correction coefficient of the cycle in association with a correction coefficient of the strength; and a setting value correction unit configured to extract, from the correction coefficient storage unit, a correction coefficient of the cycle and a correction coefficient of the strength corresponding to the specified type of sheet, and to correct the maintenance setting values decided by the maintenance setting value decision unit with the extracted correction coefficient, wherein the controller causes the maintenance unit to execute the maintenance operation, based on the maintenance setting values decided by the maintenance setting value decision unit and corrected by the setting value correction unit.

* * * * *